US005979195A

United States Patent [19]

Bestell et al.

[11] Patent Number: 5,979,195

[45] Date of Patent: Nov. 9, 1999

[54] SEAL ARRANGEMENT BETWEEN INNER AND OUTER TUBS OF A HORIZONTAL AXIS WASHING MACHINE

[75] Inventors: Gary D. Bestell; Troy A. Johnson; Louis R. Smothers; Theodore R. Van Drimmelen, all of Newton; Evan R. Vande Haar, Pella; William R. White, Newton, all of Iowa

[73] Assignee: Maytag Corporation, Newton, Iowa

[21] Appl. No.: 09/079,224

[22] Filed: May 15, 1998

[51] Int. Cl.[6] ..... D06F 37/04

[52] U.S. Cl. ..... 68/23.2; 68/24; 68/139

[58] Field of Search ..... 68/23.2, 24, 139, 68/140, 142

[56] References Cited

U.S. PATENT DOCUMENTS

| | | | |
|---|---|---|---|
| 2,613,837 | 10/1952 | Morton | 68/139 X |
| 2,966,052 | 12/1960 | Syles | 68/19.2 X |
| 2,970,717 | 2/1961 | Walker . | |
| 3,089,327 | 5/1963 | Stilwell | 68/139 |
| 3,276,229 | 10/1966 | Deiss . | |

FOREIGN PATENT DOCUMENTS 2114606 8/1983 United Kingdom .

*Primary Examiner*—Philip R. Coe
*Attorney, Agent, or Firm*—Everett G. Diederiks, Jr.

[57] ABSTRACT

A sealing device is provided to bridge a gap defined between open frontal portions of inner and outer tubs of a horizontal axis washing machine in order to prevent foreign objects from getting into the outer tub from the inner tub through the gap and potentially clogging a pumping system of the machine. In the preferred form of the invention, the sealing device includes a first seal portion fixedly secured to a lower, inner wall portion of a cover attached to the outer tub and a flexible, second seal portion which extends toward and preferably slidably contacts a balance ring provided about the open frontal portion of the inner tub. In accordance with one embodiment, the sealing device is constituted by a brush member, with the second seal portion being defined by bristles of the brush member. In another embodiment, the sealing device is constituted by a plastic film having one longitudinal side secured to the outer tub cover and another longitudinal side in sliding contact with the balance ring.

29 Claims, 5 Drawing Sheets

SEAL ARRANGEMENT BETWEEN INNER AND OUTER TUBS OF A HORIZONTAL AXIS WASHING MACHINE

BACKGROUND OF THE INVENTION

1. Field of the Invention

The present invention pertains to the art of washing machines and, more particularly, to a seal arrangement provided between inner and outer tubs of a horizontal axis washing machine.

2. Discussion of the Prior Art

Both vertical axis and horizontal axis washing machines are currently available in the marketplace for laundering articles of clothing. Due to significant improvements made in the art of horizontal axis washing machines in recent years, the demand for these types of machines are on the rise. Horizontal axis washing machines currently under production have the capability of utilizing less power and a reduced amount of water/detergent for a given washing operation over conventional vertical axis-type washing machines. Therefore, the operating costs associated with horizontal axis washing machines are typically lower than more conventional vertical axis washing machines. In addition, particularly due to the tumbling action imparted on articles of clothing being laundered in a horizontal axis washing machine, a horizontal axis washing machine generally has a greater ability to remove any tough stains on the clothing.

Obviously, there are a number of different structural features between these two types of known washing machines. However, both types of machines generally include a cabinet shell within which is suspended an outer tub. An inner tub or spinner is rotatably mounted within the outer tub, with annular side walls of the inner and outer tubs being arranged in a spaced, concentric fashion. Therefore, a gap is provided between the side walls of the inner and outer tubs, including at the open ends thereof. A pivotable door is secured to the cabinet shell for providing access to the inner tub in order to selectively load or unload laundry items. In addition, both types of machines function to wash clothes by saturating the clothes in a washing fluid and imparting various mechanical actions upon the clothes. At least during certain times in the washing operation, the washing fluid will be caused to flow from the inner tub to the outer tub. In each type of machine, at least one pump, having an input side which draws from the outer tub, is provided for draining the washing machine.

Of course, there are also some potential problems which must be overcome in the design of a horizontal axis washing machine that are simply not a consideration in the making of a vertical axis washing machine. For instance, given that the access opening to the inner tub in a horizontal axis washing machine will extend below the level of the washing fluid during operation of the machine, some of the fluid will be caused to naturally flow from the inner tub to the outer tub through the gap provided between the tubs at the open ends thereof. Without being contained within the inner tub or spinner, other objects can also be caused to flow through this gap. Therefore, string, large pieces of lint, hair and even certain objects inadvertently placed in the inner tub with the clothes to be laundered can get between the spinner and the outer tub. Typically, if the washing machine pump is capable of handling the foreign objects, there is no problem. However, if the objects are rather large in size or number, the pump may not be able to handle the objects. In this situation, the pump will clog and lead to problems for the consumer.

Based on the above, there exists a need in the art for an arrangement which will effectively prevent foreign objects from flowing through the gap formed between the inner and outer tubs of a horizontal axis washing machine in order to prolong the smooth operation of the pump, while also enhancing the overall efficiency of the machine.

SUMMARY OF THE INVENTION

The present invention is particularly concerned with preventing foreign objects, which could clog or otherwise disrupt the normal operation of a horizontal washing machine pump, from flowing through a gap provided between inner and outer tubs of the machine and reaching the pump. In accordance with the invention, a sealing device is arranged to bridge the gap, with the sealing device functioning to prevent string, large pieces of lint, hair and the like from flowing into the outer tub from the inner tub or spinner.

The sealing device includes a first seal portion which is fixed relative to one of the outer tub and the outer tub and a second seal portion which is placed in sliding contact with the other of the spinner and the outer tub. In a preferred form of the invention, the first seal portion is fixed relative to the outer tub and the second seal portion extends toward and most preferably is placed in sliding contact with a balance ring secured to an open frontal rim portion of the spinner. Preferably, a tub cover is secured about an open frontal portion of the outer tub and the first seal portion is fixed to the tub cover. In any event, the second seal portion bridges the gap between the inner and outer tubs to prevent the undesirable ingress of foreign matter into the region of the pump.

In accordance with one embodiment of the invention, the sealing device is constituted by a brush member, with the second seal portion being defined by bristles of the brush member. In another embodiment, the sealing device is constituted by a thin plastic film. In either case, the sealing device preferably extends approximately 180 degrees about the lowermost portion of the spinner, as only this section of the spinner is below a fluid level established during operation of the machine.

Additional objects, features and advantages of the sealing arrangement of the present invention will become more fully apparent from the following detailed description of preferred embodiments thereof when taken in conjunction with the drawings wherein like reference numerals refer to corresponding parts in the several views.

DETAILED DESCRIPTION OF THE PREFERRED EMBODIMENTS

Figure 1:
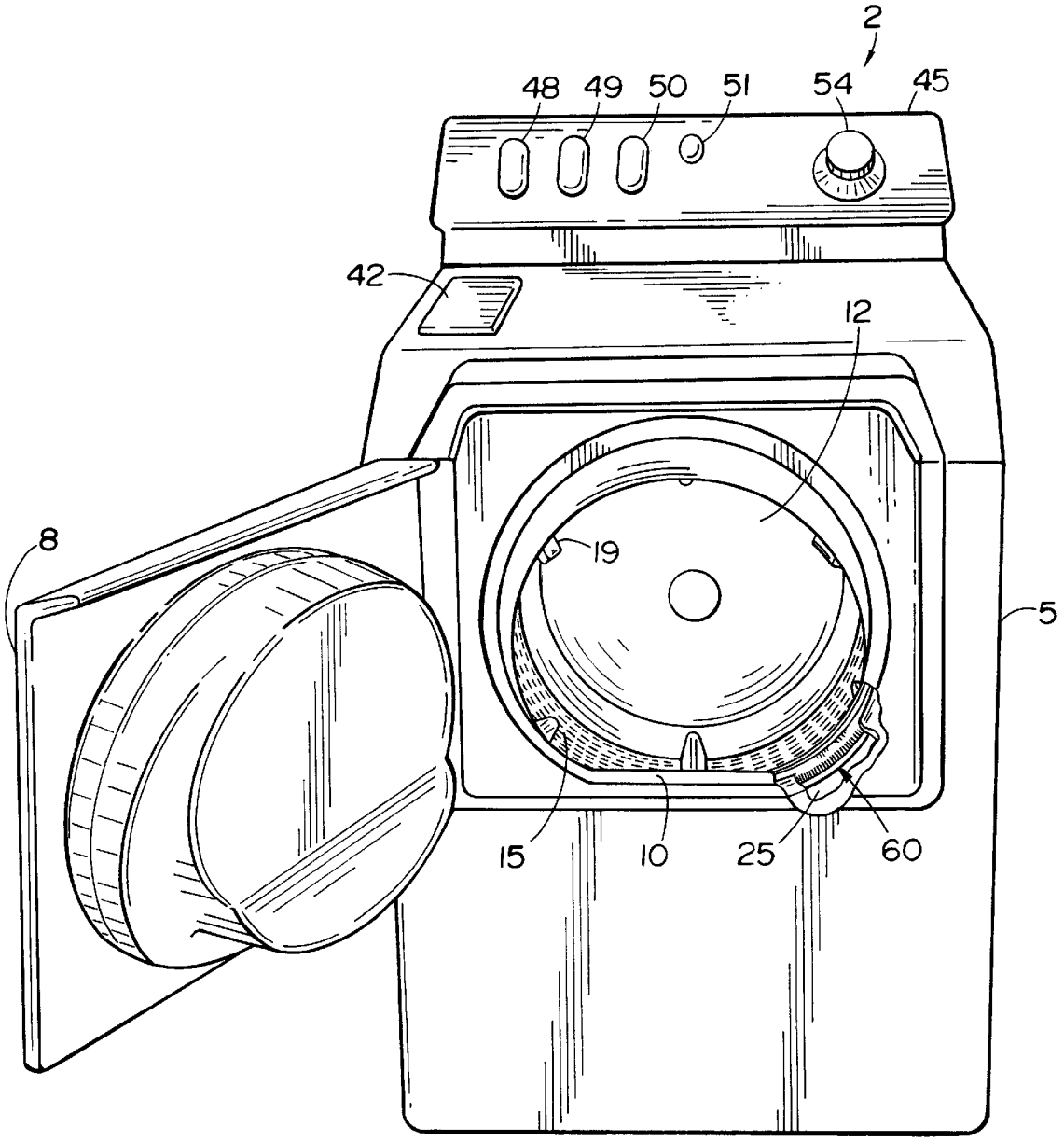
FIG. 1 is a partially cut-away, perspective view of a horizontal axis washing machine incorporating the sealing arrangement of the present invention.

With initial reference to FIG. 1, an automatic horizontal axis washing machine incorporating the seal arrangement of the present invention is generally indicated at 2. In a manner known in the art, washing machine 2 is adapted to be front loaded with articles of clothing to be laundered through a tumble-type washing operation. As shown, automatic washing machine 2 incorporates an outer cabinet shell 5 provided with a front door 8 adapted to extend across an access opening 10. Front door 8 can be selectively pivoted to provide access to an inner tub or spinner 12 that constitutes a washing basket within which the articles of clothing are laundered.

Figure 3:
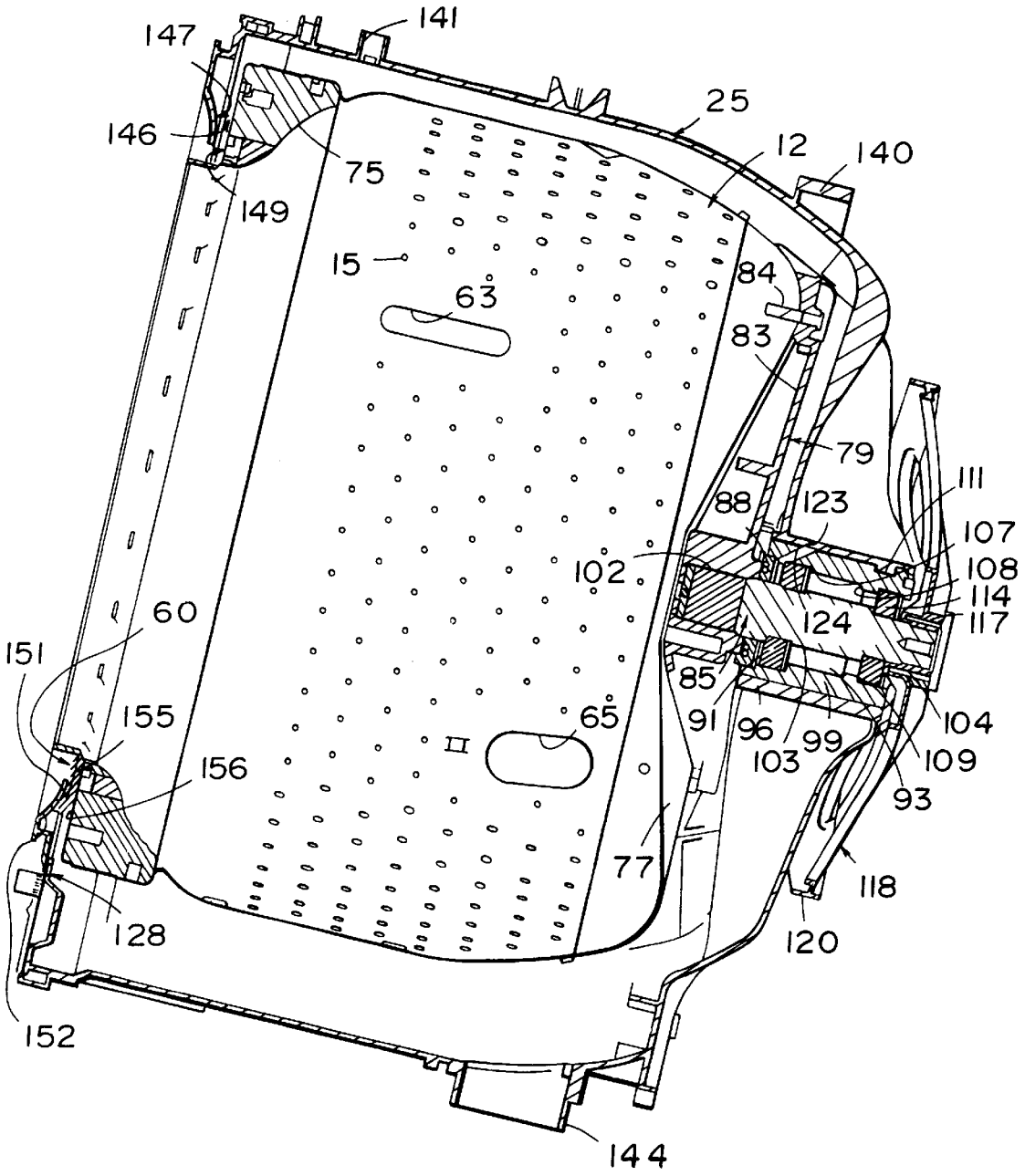
FIG. 3 is a cross-sectional view of the internal components of FIG. 2 in an assembled state.

As is known in the art, inner tub 12 is formed with a plurality of holes 15 and a plurality of radially inwardly projecting fins or blades 19 are fixedly secured to inner tub 12. Inner tub 12 is mounted for rotation within an outer tub 25, which is supported through a suspension mechanism (not shown) within cabinet shell 5. Inner tub 12 is mounted within cabinet shell 5 for rotation about a generally horizontal axis. Actually, the rotational axis is angled slightly downwardly and rearwardly as generally represented in FIG. 3. Although not shown, a motor, preferably constituted by a variable speed, reversible electric motor, is mounted within cabinet shell 5 and adapted to drive inner tub 12. More specifically, inner tub 12 is rotated during both wash and rinse cycles such that articles of clothing placed therein actually tumble through either water, water/detergent or another washing fluid supplied within inner tub 12. Given that inner tub 12 is provided with at least the plurality of holes 15, the water or water/detergent can flow between the inner and outer tubs 12 and 25. A pumping system (not shown) is provided to control the level of washing fluid within machine 2, with one pump particularly controlling the timed draining of the fluid from the outer tub 25.

The general manner in which the automatic washing machine 2 of FIG. 1 operates is well known in the art and is not considered an aspect of the present invention. Therefore, a complete description of its operation will not be described here. However, for the sake of completeness, automatic washing machine 2 is also shown to include an upper cover 42 that provides access to an area for adding detergent, softeners and the like. In addition, an upper control panel 45, including various selector buttons 48–51 and a control knob 54, is provided for manually establishing a desired washing operation in a manner known in the art.

Figure 2:
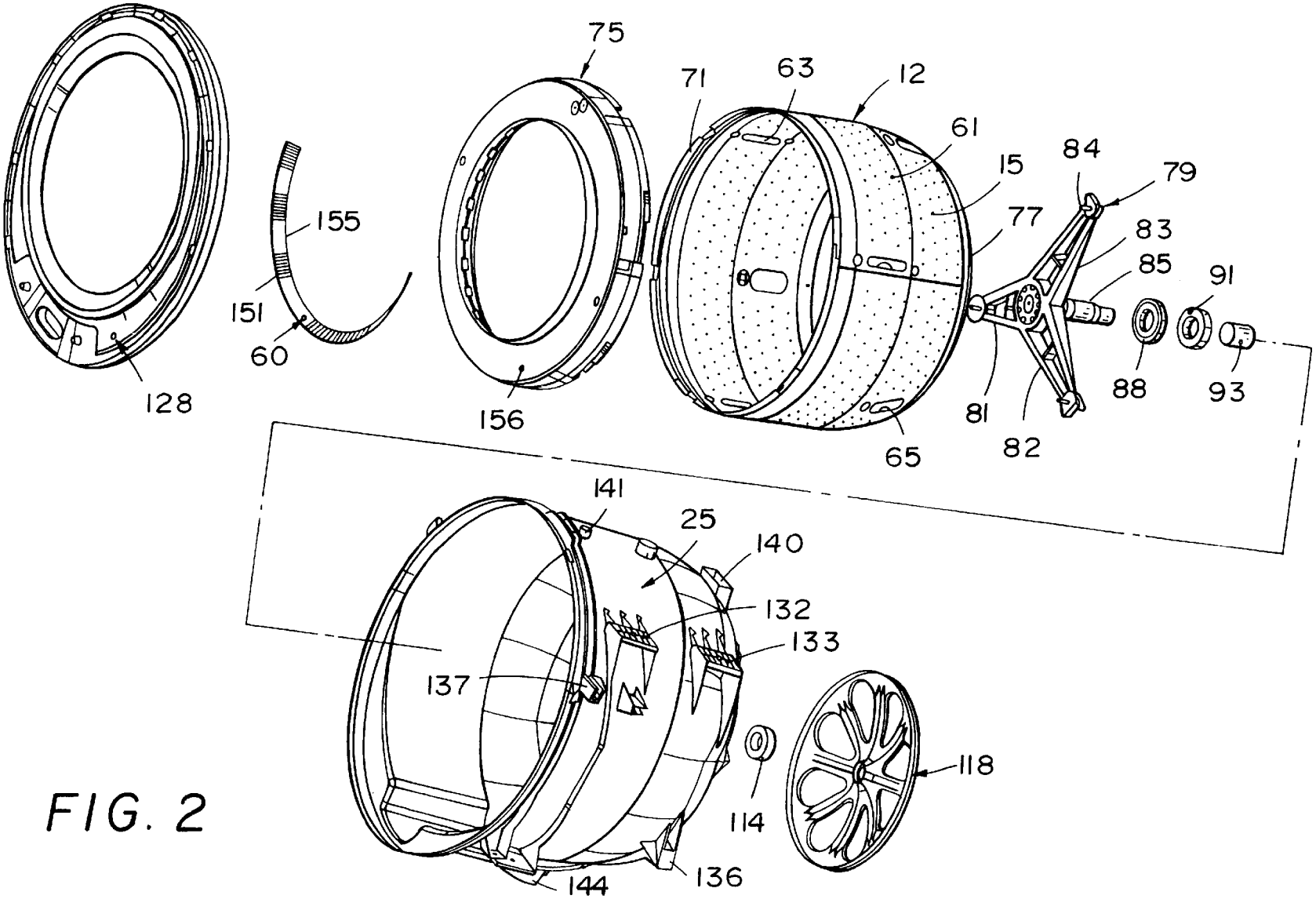
FIG. 2 is an exploded view of various internal components of the washing machine of FIG. 1.

In order to allow inner tub 12 to freely rotate within outer tub 25 during a given washing operation, inner tub 12 is spaced concentrically within outer tub 25 in the manner which will be detailed more fully below. This spacing establishes an annular, axial gap between the inner and outer tubs 12 and 25 at the open frontal portions thereof. During operation of washing machine 2, the washing fluid can flow through this gap from inner tub 12 into outer tub 25. In addition, foreign objects can also flow into the outer tub 25 through this gap. Unfortunately, it has been found that some foreign objects flowing through this gap can end up clogging or otherwise disrupting the normal operation of the pumping system, thereby leading to the need for machine repairs. In order to remedy this situation, the present invention is particularly directed to providing a flexible sealing device, generally indicated at 60 in FIG. 1, which functions to bridge this gap between inner and outer tubs 12 and 25 to prevent foreign objects from flowing into the outer tub 25. Reference now will be made to FIGS. 2 and 3 in describing the preferred mounting of inner tub 12 within outer tub 25 and the arrangement of sealing device 60.

Inner tub 12 has an annular side wall 61 formed with various circumferentially spaced forward slots 63, as well as rear slots 65. Slots 63 and 65 are actually used to permit washing fluid to flow into inner tub 12, along with holes 15, during a washing operation in a manner known in the art. Actually fins 19 are secured over respective slots 63 and 65 and therefore the fins 19 are provided with openings for permitting the washing fluid to be injected into the inner tub 12. Inner tub 12 also includes an open front rim 71 about which is secured a balance ring 75. In the preferred embodiment, balance ring 75 is injection molded from plastic, such as polypropylene, with the balance ring 75 being preferably mechanically attached to rim 71. Inner tub 12 also includes a rear wall 77 to which is fixedly secured a spinner support 79. More specifically, spinner support 79 includes a plurality of radially extending arms 81–83 which are fixedly secured to rear wall 77 by means of screws 84 or the like. Spinner support 79 has associated therewith a driveshaft 85. Placed upon driveshaft 85 is an annular lip seal 88. Next, a first bearing unit 91 is press-fit onto driveshaft 85. Thereafter a bearing spacer 93 is inserted upon driveshaft 85.

The mounting of inner tub 12 within outer tub 25 includes initially placing the assembly of inner tub 12, balance ring 75, spinner support 79, lip seal 88, first bearing unit 91 and bearing spacer 93 within outer tub 25 with driveshaft 85 projecting through a central sleeve 96 formed at the rear of outer tub 25. More specifically, a metal journal member 99 is arranged within central sleeve 96, with central sleeve 96 being preferably molded about journal member 99. Therefore, driveshaft 85 projects through journal member 99 and actually includes first, second and third diametric portions 102–104. In a similar manner, journal member 99 includes various diametric portions which define first, second and third shoulders 107–109. Journal member 99 also includes an outer recess 111 into which the plastic material used to form outer tub 25 flows to aid in integrally connecting journal member 99 with outer tub 25.

As best shown in FIG. 3, the positioning of driveshaft 85 in journal member 99 causes each of annular lip seal 88, first bearing 91 and bearing spacer 93 to be received within journal member 99. More specifically, annular lip seal 88 will be arranged between first diametric portion 102 of driveshaft 85 and journal member 99. First bearing unit 91 will be axially captured between the juncture of first and second diametric portions 102 and 103, as well as first shoulder 107. Bearing spacer 93 becomes axially positioned between first bearing unit 91 and second shoulder 108 of journal member 99. Thereafter, a second bearing unit 114 is placed about driveshaft 85 and inserted into journal member 99, preferably in a press-fit manner, with second bearing unit 114 being seated upon third shoulder 109. At this point, a hub 117 of a spinner pulley 118 is fixedly secured to a terminal end of driveshaft 85 and axially retains second bearing unit 114 in position. Spinner pulley 118 includes an outer peripheral surface 120 which is adapted to be connected to a belt driven in a controlled fashion by the reversible motor mentioned above in order to rotate inner tub 12 during operation of washing machine 2. In order to provide lubrication to lip seal 88, central sleeve 96 is formed with a bore 123 that is aligned with a passageway 124 formed in journal member 99.

Outer tub 25 has associated therewith a tub cover 128. More specifically, once inner tub 12 is properly mounted within outer tub 25, tub cover 128 is fixedly secured about the open frontal zone of outer tub 25. Although the materials for the components discussed above may vary without departing from the spirit of the invention, outer tub 25, balance ring 75 and tub cover 128 are preferably molded from plastic, while inner tub 12 is preferably formed of stainless steel. Again, these materials can vary without departing from the spirit of the invention. For example, inner tub 12 could also be molded of plastic.

Outer tub 25 is best shown in FIG. 2 to include a plurality of balance weight mounting gusset platforms 132 and 133, a rear mounting boss 136 and a front mounting support 137. It should be realized that commensurate structure is provided on an opposing side portion of outer tub 25. In any event, balance weight mounting platforms 132 and 133, mounting boss 136 and mounting support 137 are utilized in mounting outer tub 25 within cabinet shell 5 in a suspended fashion. Again, the specific manner in which outer tub 25 is mounted within cabinet shell 5 is not considered part of the present invention, so it will not be described further herein. Outer tub 25 is also provided with a plurality of fluid inlet ports 140 and 141 through which washing fluid, i.e., either water, water/detergent or the like, can be delivered into outer tub 25 and, subsequently, into inner tub 12 in the manner discussed above. Furthermore, outer tub 25 is formed with a drain port 144 which is adapted to be connected to a pump for draining the washing fluid from within inner and outer tubs 12 and 25 during certain cycles of a washing operation.

As best illustrated in FIG. 3, inner tub 12 is entirely spaced from outer tub 25 for free rotation therein. This spaced relationship also exists at the front ends of inner and outer tubs 12 and 25 such that an annular gap 146 is defined between an open frontal zone 147 of outer tub 25 and an open frontal portion 149 associated with balance ring 75. It is through a lower section of gap 146 that washing fluid can also flow from within inner tub 12 to outer tub 25. With this fluid flow, foreign objects including string, large pieces of lint, hair and the like, can get into outer tub 25. Typically, the pump associated with drain port 144 is capable of managing these foreign objects and there is no problem. However, depending upon the size and number of the foreign objects, the pump may not be able to handle the objects, whereby the pump will clog or at least the normal operation thereof will be disrupted.

Figure 4:
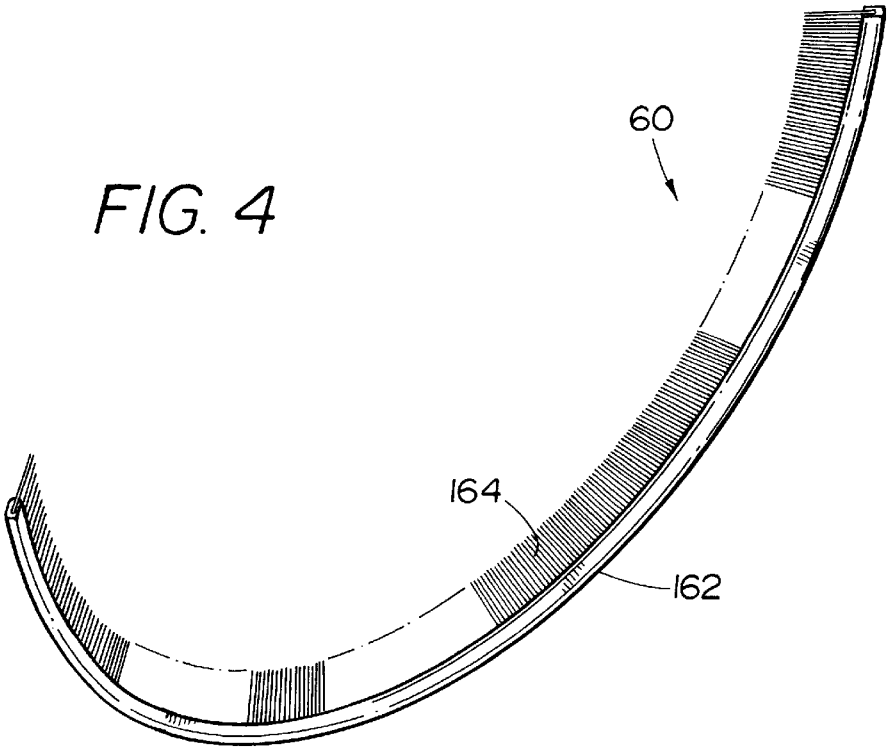
FIG. 4 is a perspective view of a sealing device constructed in accordance with a first preferred embodiment of the invention.
Figure 5:
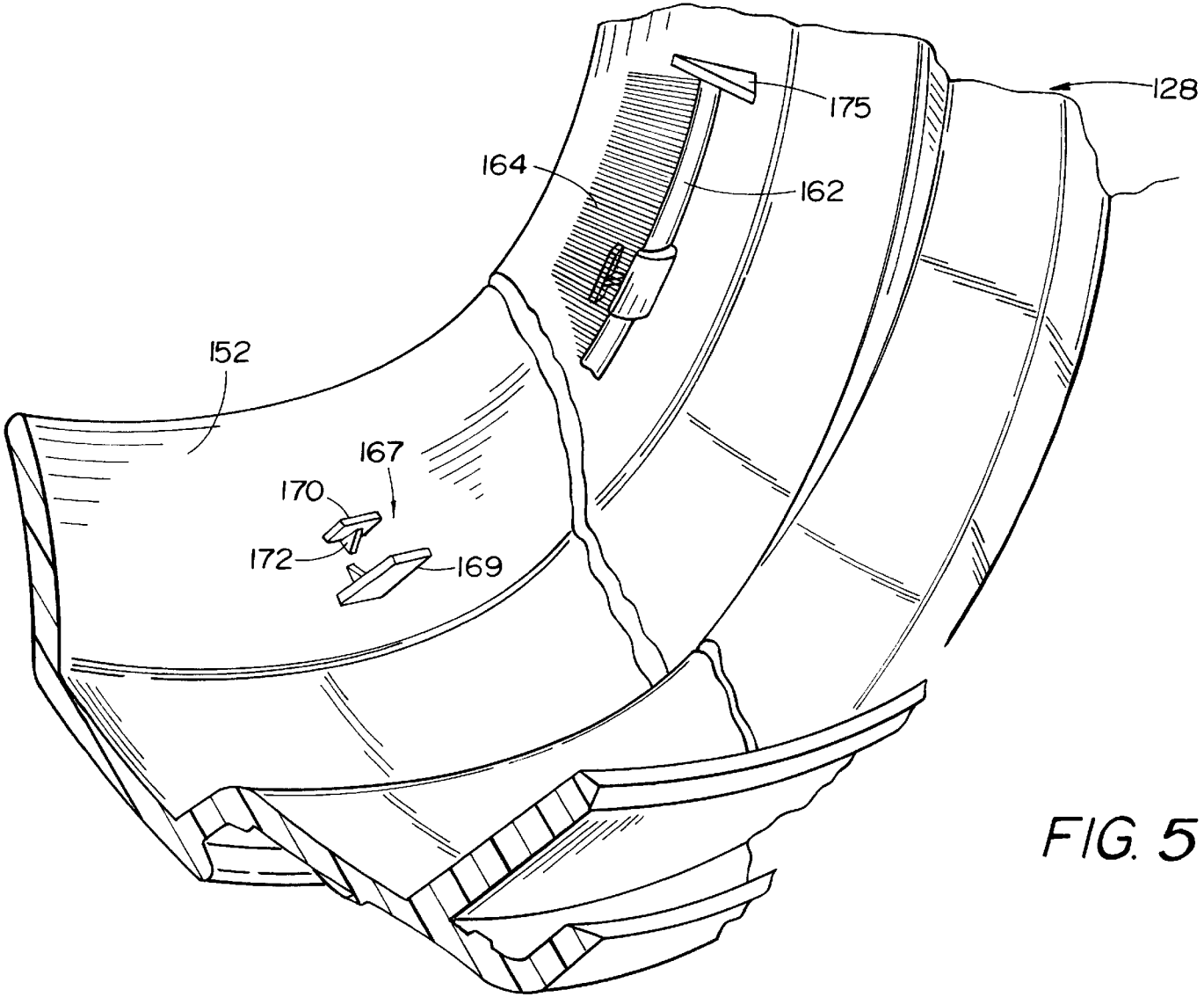
FIG. 5 is a partial, cross-sectional view of a portion of a tub cover incorporating mounting structure particularly designed for the sealing device of FIG. 4.

Because of this problem, the flexible sealing device 60 of the present invention is mounted so as to bridge gap 146 between inner and outer tubs 12 and 25 and, specifically, between balance ring 75 and tub cover 128. Gap 146 is required because of deflections between inner tub 12 and outer tub 25 during operation of washing machine 2. Sealing device 60 bridges gap 146 to prevent small items from passing through, but sealing device 60 is flexible so as to accommodate changes in the size of gap 146 resulting from deflections during operation. In accordance with the preferred form of the invention, sealing device 60 includes a first seal portion 151 that is fixed or otherwise secured to a rear or inner surface 152 of tub cover 128 and a second seal portion 155 which projects axially across gap 146 and is placed in close proximity and most preferably in sliding contact with a front or outer surface 156 of balance ring 75. In accordance with one preferred embodiment of the invention as represented in FIGS. 4 and 5, the first seal portion 151 is defined by a crimped support member 162 and the second seal portion 155 is defined by brush bristles 164. In the most preferred form of the invention, support member 162 is formed of aluminum and bristles 164 are formed of nylon.

As is known in the art, horizontal axis washing machines tend to utilize much less water than more conventional vertical axis washing machines and water is only in the lower portion of outer tub 25. For this reason, it has been determined that any foreign objects which could disrupt the preferred operation of the pumping system of the present invention can only possibly flow through a lower half portion of gap 146. For this reason and due to cost considerations, it is preferred to have sealing device 60 only extend approximately 180 degrees around the lower portion of gap 146. In accordance with the embodiment of FIGS. 4 and 5, a preferred mounting of support member 162 to inner surface 152 of tub cover 128 is carried out by integrally forming tub cover 128 with a plurality of spaced mounting units 167. Each mounting unit 167 is actually defined by a first tab 169 and a second tab 170, as well as angled locator elements 172 which take the form of gussets. As clearly shown in FIG. 5, first tab 169 of each mounting unit 167 is preferably longer than a respective second tab 170. With this arrangement, support member 162 can be positioned between each of these sets of first and second tabs 169 and 170, while being automatically located in a desired position by locator elements 172, and then first tab 169 can be sonically wedged over in the direction of second tab 170 to retain support member 162 in position. To prevent longitudinal shifting of support member 162, inner surface 152 is also provided with a pair of 180 degree spaced, terminal stop elements, one of which is indicated at 175. Therefore, each of the terminal ends of support member 162 abut a respective stop element 175 as also clearly illustrated in FIG. 5. In any event, bristles 164 project from the rear or inner surface 152 and slidably contact balance ring 75. Bristles 164 can have uniform or varying length without departing from the spirit of the invention.

Figure 6:
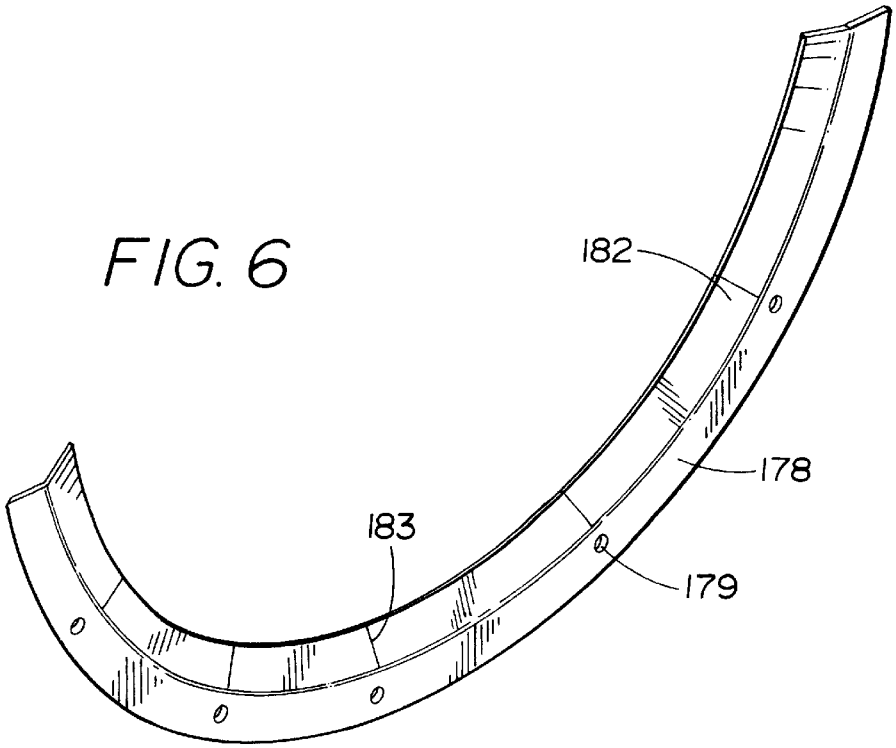
FIG. 6 is a perspective view a sealing device constructed in accordance with a second preferred embodiment of the invention.

FIG. 6 illustrates another sealing device embodiment which is formed from a thin plastic sheet or film. In accordance with this embodiment, a first seal portion 178 is provided with holes 179 for fixedly securing first seal portion 178 to inner surface 152 of tub cover 128 through the use of mechanical fasteners, molded tabs or the like. In addition, a second seal portion 182 projects from first seal portion 178 for slidably engaging balance ring 75. In this embodiment, second seal portion 182 is defined by various arcuate sections separated by split lines 183 along the length of the sealing device.

Although described with respect to preferred embodiments, it should be readily understood that various changes and/or modifications can be made to the invention without departing from the spirit thereof. For instance, although two preferred embodiments for sealing device 60 of the present invention have been described in detail, other types of sealing devices could also be readily utilized to perform the desired function. For example, a foam pad can be secured to the inner surface 152 of the tub cover 128, with the foam in close proximity to or rubbing against the outer surface 156 of balance ring 75 to prevent the foreign items from exiting the inner tub 12. In this embodiment, the foam can be attached in various ways, including placing die cut holes provided in the foam over molded bosses provided on the inner surface 152 of tub cover 128. Push nuts could then be pressed onto the molded bosses or the ends of the bosses could be sonically heated to form enlarged end caps to hold the foam in place. Even a light adhesive could be utilized as an assembly aid in securing the foam to the tub cover 128. Color matching of the foam or even the bristles 164 to the balance ring 75 and/or tub cover 128 is also envisioned. The sealing device of the present invention could also be constituted by a felt strip to bridge gap 146. Furthermore, although the preferred embodiments have been described with the first seal portions 151 being secured to tub cover 128 and the second seal portions 155 being placed in sliding contact with balance ring 75, the reverse could also be readily carried out with the second seal portion 155 actually slidably contacting the tub cover 128. Therefore, based on the above, the above description should be considered illustrative and not restrictive of the invention. Instead, the invention is only intended to be limited by the scope of the following claims.

We claim:

1. In a washing machine including an outer tub within which is mounted a spinner for rotation about a generally horizontal axis, with the spinner being adapted to receive articles of clothing to be laundered through an open frontal portion of the spinner which is spaced from the outer tub by a gap, a sealing device comprising: a first seal portion fixed relative to one of the spinner and the outer tub and a second seal portion extending towards another of the spinner and the outer tub in order to bridge the gap, with the sealing device extending about solely a lower section of the frontal portion of the spinner to prevent foreign objects from passing through the gap between the frontal portion and the outer tub during operation of the washing machine.

2. The sealing device according to claim 1, wherein the first seal portion is fixed relative to the spinner and the second seal portion is in close proximity with the frontal portion of the spinner.

3. In a washing machine including an outer tub, within which is mounted a spinner for rotation about a generally horizontal axis, and a balance ring secured about a frontal portion of the spinner, with the spinner being adapted to receive articles of clothing to be laundered through the open frontal portion of the spinner which is spaced from the outer tub by a gap, a sealing device comprising: a first seal portion fixed relative to the spinner and a second seal portion extending towards the outer tub and being in sliding contact with the balance ring in order to bridge the gap, with the sealing device extending about at least a lower section of the frontal portion of the spinner to prevent foreign objects from passing through the gap between the frontal portion and the outer tub during operation of the washing machine.

4. The sealing device according to claim 3, further comprising, in combination: a tub cover secured about an open frontal zone of the tub, with the first seal portion of the sealing device being fixedly secured to the tub cover.

5. The sealing device according to claim 4, wherein the first seal portion extends approximately 180 degrees about the tub cover.

6. The sealing device according to claim 4, further comprising: a plurality of mounting elements spaced along an inner surface portion of the tub cover, with the first seal portion of the sealing device being secured to the tub cover at each of the mounting elements.

7. The sealing device according to claim 6, wherein the plurality of mounting elements extend less than 180 degrees along the inner surface portion of the tub cover.

8. The sealing device according to claim 7, further comprising: stop elements arranged at spaced locations along the inner surface portion of the tub cover, with the sealing device having terminal end portions adapted to abut the stop elements in order to limit shifting of the sealing device about the inner surface portion.

9. The sealing device according to claim 6, wherein each of the mounting elements includes first and second spaced tabs, with the first seal portion of the sealing device being located between the first and second tabs.

10. The sealing device according to claim 9, wherein the first tab of each mounting element is longer than the second tab, with one of the first and second tabs being adapted to extend over the first seal portion of the sealing device to retain the sealing device between the first and second tabs.

11. The sealing device according to claim 1, wherein the second seal portion is constituted by brush bristles.

12. The sealing device according to claim 1, wherein the second seal portion is constituted by a plastic film.

13. A washing machine comprising:

a cabinet shell;

an outer tub mounted within the cabinet shell in a substantially fixed position, said outer tub having an open frontal zone;

a spinner supported within said outer tub for rotation about a substantially horizontal axis, said spinner including an open frontal portion which is substantially aligned with the open frontal zone of the outer tub so as to enable articles of clothing to be selectively placed within and removed from the spinner for laundering of the clothing, said open frontal portion being spaced from the open frontal zone by a gap;

a door pivotally attached to the cabinet shell, said door being selectively movable between a closed position, wherein the door extends across the open frontal zone of the outer tub and the open frontal portion of the spinner, and an open position wherein access to within the spinner is permitted; and means for sealing solely a lower arcuate section of the gap between the outer tub and the spinner to prevent foreign objects from passing through the gap during operation of the washing machine.

14. The washing machine according to claim 13, wherein the sealing means includes a first seal portion fixed relative to one of the spinner and the outer tub and a second seal portion in close proximity with another of the spinner and the outer tub.

15. A washing machine comprising:

a cabinet shell;

an outer tub mounted within the cabinet shell in a substantially fixed position, said outer tub having an open frontal zone;

a spinner supported within said outer tub for rotation about a substantially horizontal axis, said spinner including an open frontal portion which is substantially aligned with the open frontal zone of the outer tub so as to enable articles of clothing to be selectively placed within and removed from the spinner for laundering of the clothing, said open frontal portion being spaced from the open frontal zone by a gap;

a balance ring secured about the frontal portion of the spinner;

a door pivotally attached to the cabinet shell, said door being selectively movable between a closed position, wherein the door extends across the open frontal zone of the outer tub and the open frontal portion of the spinner, and an open position wherein access to within the spinner is permitted; and means for sealing at least a lower arcuate section of the gap between the outer tub and the spinner to prevent foreign objects from passing through the gap during operation of the washing machine, wherein the sealing means includes a first seal portion fixed relative to one of the spinner and a second seal portion, with the second seal portion of the sealing device being in sliding contact with the balance ring.

16. The sealing device according to claim 15, further comprising, in combination: a tub cover secured about the open frontal zone of the tub, with the first seal portion of the sealing device being fixedly secured to the tub cover.

17. The sealing device according to claim 16, wherein the first seal portion extends approximately 180 degrees about the tub cover.

18. The sealing device according to claim 16, further comprising: a plurality of mounting elements spaced along an inner surface portion of the tub cover, with the first seal portion of the sealing device being secured to the tub cover at each of the mounting elements.

19. The sealing device according to claim 14, wherein the second seal portion is constituted by brush bristles.

20. The sealing device according to claim 14, wherein the second seal portion is constituted by a plastic film.

21. The sealing device according to claim 1, further comprising, in combination: a tub cover secured about an open frontal zone of the outer tub, with the first seal portion of the sealing device being fixedly secured to the tub cover.

22. The sealing device according to claim 1, wherein the first seal portion extends approximately 180 degrees about the tub cover.

23. The sealing device according to claim 22, further comprising: a plurality of mounting elements spaced along an inner surface portion of the tub cover, with the first seal portion of the sealing device being secured to the tub cover at each of the mounting elements.

24. The sealing device according to claim 23, further comprising: stop elements arranged at spaced locations along the inner surface portion of the tub cover, with the sealing device having terminal end portions adapted to abut the stop elements in order to limit shifting of the sealing device about the inner surface portion.

25. In a washing machine including an outer tub, within which is mounted a spinner for rotation about a generally horizontal axis, and a tub cover secured about an open frontal zone of the outer tub, with the spinner being adapted to receive articles of clothing to be laundered through an open frontal portion of the spinner which is spaced from the outer tub by a gap, a sealing device comprising: a plurality of mounting elements spaced along an inner surface portion of the tub cover, a first seal portion fixedly secured to the tub cover at each of the mounting elements and a second seal portion extending towards the spinner in order to bridge the gap, with the sealing device extending about at least a lower section of the frontal portion of the spinner to prevent foreign objects from passing through the gap between the frontal portion and the outer tub during operation of the washing machine.

26. The sealing device according to claim 25, wherein the plurality of mounting elements extend less than 180 degrees along the inner surface portion of the tub cover.

27. The sealing device according to claim 25, further comprising: stop elements arranged at spaced locations along the inner surface portion of the tub cover, with the sealing device having terminal end portions adapted to abut the stop elements in order to limit shifting of the sealing device about the inner surface portion.

28. The sealing device according to claim 25, wherein each of the mounting elements includes first and second spaced tabs, with the first seal portion of the sealing device being located between the first and second tabs.

29. The sealing device according to claim 28, wherein the first tab of each mounting element is longer than the second tab, with one of the first and second tabs being adapted to extend over the first seal portion of the sealing device to retain the sealing device between the first and second tabs.

* * * * *